United States Patent [19]

Bryce

[11] Patent Number: 4,682,839

[45] Date of Patent: Jul. 28, 1987

[54] MULTI-ROW MODULAR ELECTRICAL CONNECTOR

[75] Inventor: J. Robert Bryce, Fairport, N.Y.

[73] Assignee: Crane Electronics, Inc., Cincinnati, Ohio

[21] Appl. No.: 824,156

[22] Filed: Jan. 30, 1986

[51] Int. Cl.[4] ..... H01R 13/506

[52] U.S. Cl. ..... 439/598; 439/701

[58] Field of Search ..... 339/91 R, 206 R, 206 P, 339/198 G, 198 GA, 198 H

[56] References Cited

U.S. PATENT DOCUMENTS

| | | | |
|---|---|---|---|
| 2,469,397 | 5/1949 | Mezek | 173/328 |
| 2,928,066 | 3/1960 | Gordon | 339/198 |
| 3,042,895 | 7/1962 | Bonhomme | 339/176 |
| 3,135,572 | 6/1964 | Curtis et al. | 339/198 |
| 3,173,738 | 3/1965 | Gluntz | 339/198 |
| 3,253,252 | 5/1966 | Piperato et al. | 339/198 |
| 3,259,870 | 7/1966 | Winkler | 339/49 |
| 3,388,885 | 6/1968 | Holmes | 248/310 |
| 3,399,374 | 8/1968 | Pauza et al. | 339/91 |
| 3,409,858 | 11/1968 | Krehbiel | 339/91 R |
| 3,439,314 | 4/1969 | Lightner et al. | 339/208 |
| 3,456,231 | 7/1969 | Paullus et al. | 339/60 |
| 3,471,822 | 10/1969 | Van Baelen | 339/198 |
| 3,531,759 | 9/1970 | Hansen | 339/63 |
| 3,559,813 | 2/1971 | Sosinski | 339/198 |
| 3,560,910 | 2/1971 | Sosinski | 339/217 |
| 3,594,696 | 7/1971 | Witek, Jr. | 339/60 |
| 3,605,068 | 9/1971 | Rayburn | 339/49 |
| 3,656,086 | 4/1972 | Debaigt | 339/92 |
| 3,676,833 | 7/1972 | Johnson | 339/49 |
| 3,701,087 | 10/1972 | Bernard | 339/198 |
| 3,789,343 | 1/1974 | Hirokawa et al. | 339/49 |
| 3,848,951 | 11/1974 | Michaels et al. | 339/91 R |
| 3,884,544 | 5/1975 | Lundergan et al. | 339/198 |
| 3,901,575 | 8/1975 | Hoover | 339/91 |
| 4,090,764 | 5/1978 | Malsby et al. | 339/198 GA |
| 4,148,543 | 4/1979 | Shores | 339/143 |
| 4,343,528 | 8/1982 | Lucius et al. | 339/198 |
| 4,354,719 | 10/1982 | Weidler | 339/59 |
| 4,368,939 | 1/1983 | Foederer | 339/59 |
| 4,484,792 | 10/1984 | Tengler et al. | 339/143 |
| 4,596,436 | 6/1986 | Kraemer et al. | 339/206 R |

FOREIGN PATENT DOCUMENTS

| | | |
|---|---|---|
| 62250 | 11/1913 | Fed. Rep. of Germany . |
| 1206354 | 2/1960 | France . |
| 1232356 | 10/1960 | France . |
| 287435 | 7/1931 | Italy . |

OTHER PUBLICATIONS

Molex Two-row modular connector housing and modules (Model).

*Primary Examiner*—John McQuade

*Attorney, Agent, or Firm*—Wood, Herron & Evans

[57] ABSTRACT

A multi-row modular electrical connector is described having a securement mechanism in the cell walls and the wall of each module for cooperatively, tridimensionally securing each module to the cell. The securement mechanism comprises (i) a row of notches in each cell wall; (ii) a locking projection on one wall of each module; (iii) a slotted locking bar along the rearward edge of each cell wall exterior spaced away from the cell cavity; and (iv) a wedging wall on one wall of each module near the rear thereof snugly receivable through the slot of the locking bar. Each notch has a slotted access portion spaced from the cell cavity and a tab therebetween and the projections each have a wall receivable in the notch to provide a first dimension of securement and wings spaced from and overlying the module wall and sized to be received in the slotted access portion with the tab receivable between the wings and the module wall to prevent the wings from passing into the cell cavity to provide a second dimension of securement. The wedging wall passes snugly under the locking bar when the module is almost completely inserted in the cavity whereby the locking bar is behind the wedging wall to wedge the module between the locking bar and a vertical rib in the front of the cell and/or a front of the locking projection and an end wall of the notch to provide a third dimension of securement.

42 Claims, 3 Drawing Figures

MULTI-ROW MODULAR ELECTRICAL CONNECTOR

BACKGROUND OF THE INVENTION

I. Field of the Invention

This invention relates to electrical connectors of the modular type and specifically to such electrical connectors having more than one row of modules receivable in a modular housing or cell.

II. Description of the Prior Art

A typical multi-row modular electrical connector includes a housing or cell having a rectangular cross-section cavity or receiving area into which is receivable a plurality of rectangular cross-section modules each adapted to carry electrical contacts. The modules may, for example, be arranged into two rows, one overlying the other, between upper and lower housing or cell walls. Normally, the electrical contacts of each module are contained in through-bores between the upper and lower walls of the module. The modular upper and lower walls are spaced-apart a fixed distance and thus each module will typically have the same height. When stacked into two rows in the cell, the rows have a combined height of twice a module height. Hence, the cavity has a height between the inner surfaces of the upper and lower cell walls of twice a module height to snugly receive therebetween the two rows of modules.

The width of each module will vary, however, depending upon the number of contacts therein. As is well understood, a standard in the industry today is to place electrical contacts on approximately 0.1 inch centers. Thus, a two-contact module will have a width of approximately 0.2 inch (about 0.1 inch from contact center to contact center and about 0.05 inch between each contact center and the nearest outside edge of the module). Similarly, a module carrying five contacts will have a width of about 0.5 inch, ten contacts a width of about 1.0 inch, etc. Typically the modules are selected such that each row will have the same number of contacts, i.e., the same width.

By way of example, a modular connector may have twenty contacts carried by a total of three modules divided into a first row of two five contact modules and a second row of one ten contact module. Hence, each row will be approximately one inch wide. Also, to be compatible with the industry standard, the rows will each be about 0.1 inch in height and the cell cavity thus about 0.2 inch in height.

A wiring harness may be assembled with the foregoing exemplary connector by terminating a first set of five wires in five electrical contacts carried by the first module, terminating a second set of five wires in five electrical contacts carried by the second module and terminating a set of ten wires in ten electrical contacts carried by the third module. The three modules may then be inserted into the cell cavity, one at a time, to form the above-described two rows.

Once assembled, the modules would typically be held securely within the cell cavity by virtue of the tight friction fit between each module and the cell walls and the other modules. Also, to insure that the modules would remain in the cavity, the front of the cell would typically be provided with at least one rib extending between the upper and lower cell walls, and lips associated with each cell wall at the back thereof which would typically project into or toward the cavity. When the module is placed in the cavity, the front thereof would contact a rib and the back would contact the lips thereby wedging the module therebetween.

During assembly, the lips (and associated wall) would have to be urged from out of the cavity, i.e., out of path of the module, as the module entered the cell cavity and until the module was completely within the cavity (and contacting one of the forwarding ribs) whereupon the lip would snap back into place. As a result, the lips would likely be pressing tightly against the module wall during the entire traverse of the module as it entered the cell cavity. This tight press would make assembly very difficult. In the event of repair or the like, disassembly would also likely be very difficult for the same reason. Also, to remove a module would require urging the lips out of the path of the module and because the lips project into the cavity, it may be that some attempts to move the lips out of the way would result in damage to the cell and/or a module. Moreover, to first insert a module into the cell after one row is in place would require angling the module to wedge the lips outwardly making assembly more complicated.

In addition to the foregoing, repair or the like necessitating disassembly might typically result in a further problem, especially for the multi-row modular connector. This problem is one of mispositioning of modules during reassembly. For example, if the ten contact module of the previous exemplary connector were removed, the upper pair of five contact modules would be subject to falling away from the inner surface of the wall of the cell which they would otherwise be wedged against by the ten contact module. As a result, the modules may all fall lose from the cell leading to the possibility that the field technician might reinstall them in an incorrect position (e.g., the field technician may, for example, put the pair of five contact modules in the opposite order then that which was intended). This problem, of course, becomes more aggravated as the number of modules in each row increases. Accordingly, when the incorrectly reassembled connector is plugged into a mating connector, the electrical equipment involved will be wired incorrectly possibly leading to failure of, or damage to, the electrical equipment. Additionally, the dual row modular connector presents the assembly problem of keeping one row of modules in place before the second row is inserted.

Previously, in addition to the one dimensional securement provided by wedging (the module was restrained from movement fore and aft of the cell), multi-row modular connectors also provided a second dimension of securement to prevent lateral (left and right) shifting of a module. In the previous example, if one of the five contact modules were removed, the ten contact module would keep the other five contact module in its row thus making the first dimensional securement operative. To prevent lateral shifting, the modules might be provided with a rail on one wall thereof receivable in a slot in the cell walls. The rails, when so received, would prevent lateral shifting. Of course, such one and two-dimensional securement require restraint of movement in a third dimension (up or down, i.e., towards or away from a cell wall) to function. This third dimension of securing was provided by cooperation between modules of different rows. Hence, when the ten contact module is removed as described, the other modules may fall from the cell wall whereby the first and/or second dimensions of securing are no longer operative. The third dimension of securement is thus provided by other modules and the first and second dimensions of securement depend thereon as well. Because of this dependence on other modules, the aforementioned assembly and positioning difficulties and the like are present in the multi row modular connectors.

SUMMARY OF THE INVENTION

The present invention provides a multiple row modular connector which eliminates the assembly drawbacks previously encountered. One aspect of the present provides a modular connector having tridimensional securement of each module to the cell independent of whether other modules are in the cell. Further, the present invention provides a modular electrical connector in which insertion and removal of the module is easily accomplished without sacrificing any of the three dimensions of securement. Further yet, the present invention provides a modular electrical connector which reduces or eliminates mispositioning error during removal and reinsertion of one or more of the modules.

Thus, in accordance with the present invention and in its broadest aspects, a modular electrical connector is provided with a securement mechanism in the cell walls and the wall of each module for cooperatively, tridimensionally securing each module to the cell. Preferably, the securement mechanism comprises a row of notches in each cell wall and a locking projection on one wall of each module wherein each notch has a slotted access portion spaced from the cell cavity and a tab therebetween and the projections each have an upstanding wall and outwardly extending wings spaced above the module wall, the upstanding wall sized to be received in the notch to provide a first dimension of securement (left and right), the wings sized to be received in the slotted access portion whereby the tab is receivable between the wings and the module wall to prevent the wings from passing into the cell cavity to provide a second dimension of securement (up or down). The securement mechanism further preferably comprises a slotted locking bar along the rearward edge of each cell wall exterior spaced away from the cell cavity and a wedging wall on one wall of each module near the rear thereof snugly receivable through the slot of the locking bar. The wedging wall does not engage the locking bar until the module is almost completely inserted in the cavity at which time the locking bar is urged away for the wedging wall to pass thereunder. Thereafter, the locking bar returns to position behind the wedging wall to (i) wedge the forward end of the projection and the wedging wall between an end wall of the notch and the locking bar, respectively, and/or (ii) wedge the module between a vertical rib in the front of the cell and the locking bar, either or both, to provide a third dimension of securement (fore and aft). Further preferably, the wedging wall is the rearwardmost wall of the locking projection.

As a result of the foregoing, each module is tridimensionally secured to the cell independent of each other module. Hence, upon removal of any one module, the others will remain securely in the cell thereby reducing the possibility of mispositioning during reassembly and making dual row connector assembly more easily achieved. Further, the wedge wall and locking bar cooperate to advantageously provide fore and aft securement without interfering substantially with assembly and disassembly of the connector.

BRIEF DESCRIPTION OF THE DRAWINGS

These and other features and advantages of the invention will become more readily apparent from the following detailed description taken with the accompanying drawings in which.

DETAILED DESCRIPTION OF THE DRAWINGS

Figure 1:
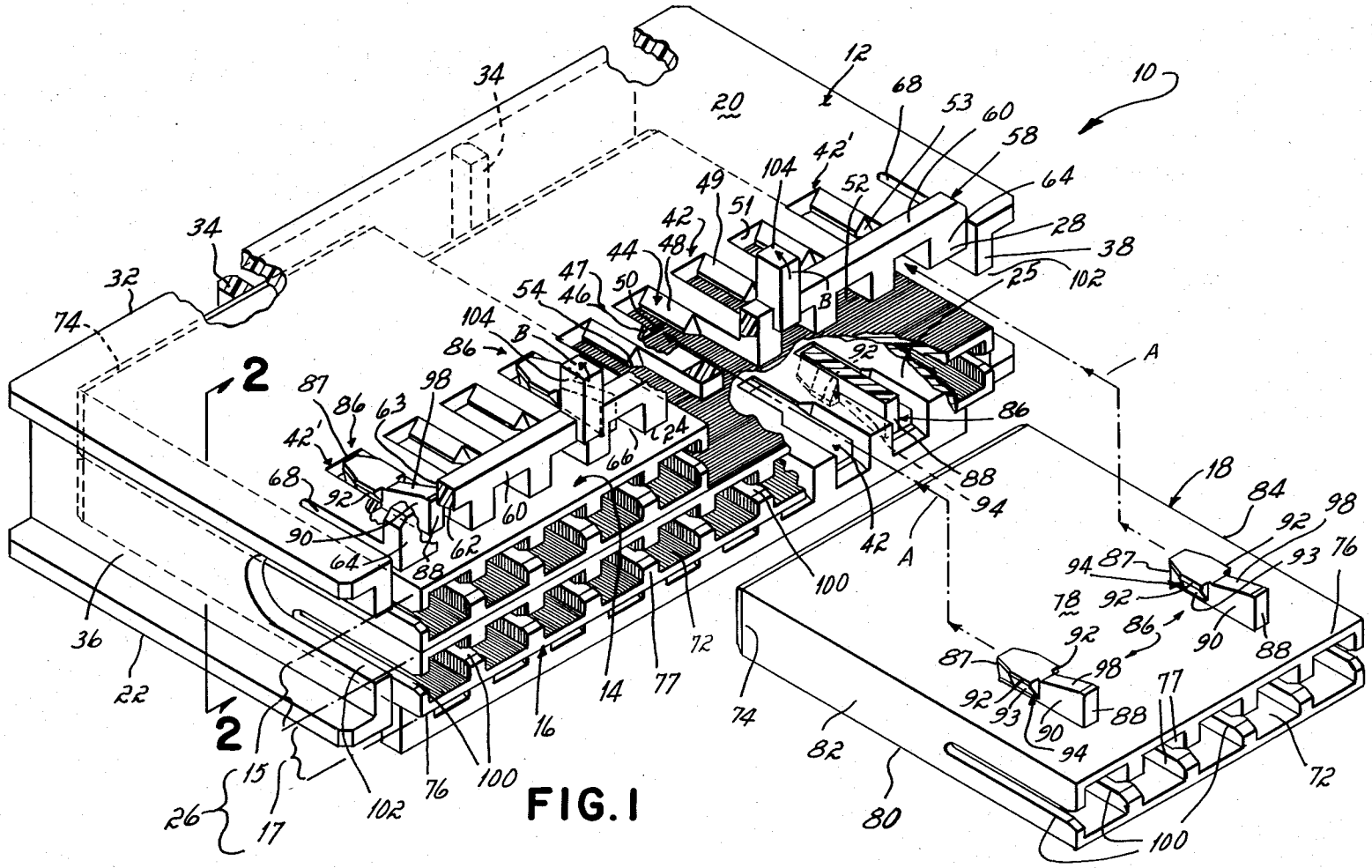
FIG. 1 is an isometric, partially cut away, partially exploded view of a modular electrical connector according to the principles of the present invention.

With reference to FIG. 1, there is shown an exemplary modular electrical connector 10 according to the principles of the present invention. Connector 10 comprises a plastic (generally electrically nonconducting) housing or cell 12 to which is removably, secured a first five-contact plastic module 14 in a first row 15 and a ten-contact plastic module 16 in a second row 17. Shown exploded from cell 12 but removably, secureable thereto along arrows A into first row 15 is a second five-contact plastic module 18.

Figure 2:
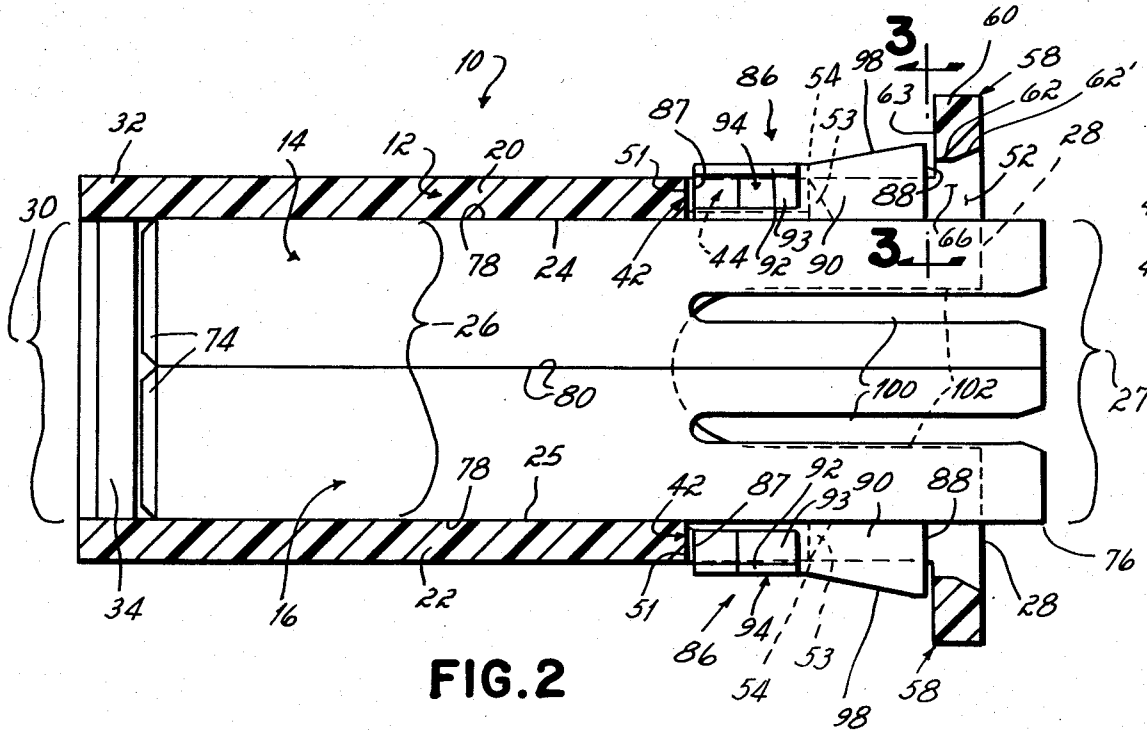
FIG. 2 is a cross-sectional view along lines 2—2 of FIG. 1.

With reference to FIGS. 1 and 2, it can be seen that cell 12 may comprise upper wall 20 and lower wall 22. The planar and parallel inner surfaces 24, 25 of walls 20,22, respectively, define a rectangular cross-section cavity or receiving area 26 therebetween. Cavity 26 also extends from a rearwardly access opening 27 defined between the rearward edges 28 of walls 20 and 22, and a forwardly access opening 30 defined between the forward edges 32 (about 0.6 inches forwardly of edges 28) of walls 20 and 22. Extending between walls 20 and 22 and partially blocking forwardly opening 30 are a pair of vertical ribs 34 for purposes to be explained hereafter.

Walls 20,22 are preferably spaced apart to define a cavity 26 with a height of about 0.2 inches to provide standard industry accepted 0.1 inch center spacing for the two rows of contacts (not shown) in modules 14,16,18. The width of cavity 26 is determined by the number of electrical contacts (not shown) to be carried by the connector 10, which in the exemplary case shown is twenty, ten per row. Hence, cavity 26 has a width of about 2.0 inches between left wall 36 and right wall 38 which interconnect walls 20 and 22.

Along each rearward edge 28 of walls 20 and 22, cell 12 is provided with securement devices which cooperate with mating securement devices on modules 14,16,18 to provide tridimensional securement of each of the modules to cell 12 independent of whether any of the other modules is received in cavity 26. For explanation purposes, the cell securement devices associated with wall 20 will be described. It should be understood that wall 22 contains identical securement devices and cell 12 would appear virtually identical if viewed upside down with respect to the view of FIG. 1.

Figure 3:
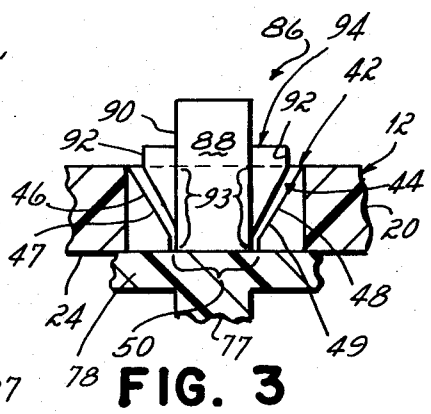
FIG. 3 is a view along lines 3—3 of FIG. 2.

The securement devices of cell 12 comprise a row of notches 42 extending from the rearward edge 28 of wall 20 and toward the forwardly edge 32 thereof. As seen in FIG. 3, each notch 42 includes an upper slotted access portion 44 spaced from cavity 26 and a pair of confronting tabs 46,48 between access portion 44 and the cavity 26. Preferably, tabs 46,48 have angled surfaces 47,49 to define a gap 50 having a dove-tail cross-section larger near access portion 44 and narrower near receiving area 26. Further preferably, tabs 46,48 extend from front or end wall 51 of the notch 42 only part way towards the rear 52 of notch 42 (at rearward edge 28) thereof. The terminus 54 of each tab 46,48, defines a cam surface 53 to guide the securement device of the module into access portion 44 as will be explained. Preferably, notches 42 are equally spaced apart on about 0.1 inch centers and outmost notches 42' are equally spaced (about 0.05 inch) from left and right walls 36 and 38 respectively. Thus, for a two inch wide cell (ten contacts per row), wall 20 has nine such notches 42. The securement devices of cell 12 also include along rearward edge 28 of wall 20, and exteriorly of cavity 26, a slotted locking bar 58. Locking bar 58 includes an upper rail 60 which extends generally parallel but spaced from inner surface 24. Underside wall 62 of rail 60 is normally spaced from inner surface 24 (and, hence, cavity 26) a predetermined distance, preferably about 0.04 inch. The forwardside 63 of rail 60 is spaced rearwardly of front edge 32 (and, hence, rearwardly of access portion 30) a predetermined distance. Forwardside 63 is also spaced rearwardly of end wall 51 another, shorter, predetermined distance. Rail 60 is connected to wall 20 by struts or ribs 64 at each end of rail 60. Preferably, rail 60 is connected to wall 20 by a plurality of struts or ribs 64 which cooperate to define a plurality of slots 66 in locking bar 60, one slot 66 coextensive and communicating with each notch 42. Locking bar 58 is resiliently urgeable further from cavity 26 for purposes to be explained. To assist such flexing of bar 58, slits 68 are provided in wall 20.

With respect to modules 14,16,18, they are each adapted to carry electrical contacts (not shown) in through-bores or access slots 72 extending between the front 74 and back 76 of each module. Bores 72 are separated by dividers 77 as is well understood. Slots 72 and dividers 77 are positioned between planar and parallel first and second module walls 78,80, respectively. Module walls 78 and 80 are preferably spaced apart about 0.1 inch to permit reception in 0.2 inch high cavity 26 in two rows as previously indicated. Each module is of a width defined between left and right module walls 82,84 connecting walls 78 and 80. This width is related to the number of bores 72. Hence, modules 14 and 18 each have five bores 72 (to carry five contacts (not shown)) and are about 0.5 inches wide, whereas module 16 has ten bores 72 (to carry ten contacts (not shown)) and is about 1.0 inches wide. Thus, when received in cavity 26, the modules define two rows 15 and 17, each about 1.0 inch wide.

As can be seen from the Figs., cavity 26 is preferably rectangular in cross-section. Likewise each of the modules is preferably rectangular in cross-section. When received in cavity 26, one wall 78 of each module is adjacent an inner surface 24 or 25 (as appropriate) of cavity 26 and the other wall 80 of each module is adjacent another wall 80 of another module to define the two stacked rows 15,17.

The previously mentioned mating securement devices of the modules will be discussed with reference to one module. It should be appreciated that one or more of the mating securement devices is provided on each module. Each mating securement device is formed integrally one wall 78 of a module. The mating securement devices comprise at least one locking projection 86, the rearwardly wall of which comprises a wedging wall 88. The locking projection 86 includes a generally perpendicularly extending wall 90 sized to be received in gap 50. Projection 86 also includes wings 92 spaced about 0.03 inch from an overlying wall 78 and sized to be receivable in the slotted access portion 44. When so received, wall 90 is at least partially within notch 42 and thus is generally restrained from movement in at least one dimension, i.e., between left and right walls 36 and 38 respectively (left and right as seen in FIG. 3). Further, tabs 46,48 are receivable in an area 93 between wings 92 and wall 78 (see FIG. 3) to generally restrain movement of the locking projection 86 in at least a second dimension (up or down—down as seen in FIG. 3 for a module in row 15 and up for a module in row 17). Preferably, wall 90 includes a dove-tail shaped support member (94) in area 93 between wings 92 and wall 78 to be matingly received in gap 50 defined between tabs 46,48. As will be appreciated, these first two dimensions of securement operate independently of whether any other module is in cell cavity 26. Further, because projections 86 are integral a module, the module is also restrained from movement in the aforesaid two dimensions.

To provide the third dimension of securement, wedging wall 88 is provided to cooperate with locking bar 58. Wedging wall 88 is spaced from front 74 of the module a distance approximately equal to the distance between forwardly access opening 30 and the forwardside 63 of rail 60, i.e., about 0.52 inch. Also, wedging wall 88 is spaced from front 87 of projection 86 a distance approximately equal to the distance between forwardside 63 and end wall 51, i.e., about 0.15 inch. Additionally, wedging wall 88 extends perpendicularly from wall 78 a distance greater than the distance between the underside 62 of rail 60 and inner surface 24, i.e., about 0.05 inch. Hence, when a module is received in cavity 26, the front 74 thereof contacts a rib 34, the front 87 of projection 86 contacts notch end wall 51, and wedging wall 88 contacts forwardside 63 of rail 60 to wedge the module in cavity 26 in a manner to provide a third dimension of securement (i.e., fore and aft or into and out of cell 12) independent of whether another module is within cavity 26.

Preferably, wings 92 and wedging wall 88 are integral wall 90 as shown in FIG. 1. Further preferably, wall 90 includes an upper cammed surface 98 between wings 92 and wedging wall 88. Cammed surface 98 of wall 90 cooperates with underside 62 (and cammed surface 62') of rail 60 to urge rail 60 away from cavity 26 to permit wedging wall 88 to pass thereunder as will be described. Further preferably, each module is provided with two such locking projections 86 formed in line with the two outermost dividers 77 (in a two contact module (not shown), there is only one such wall 77 in which event preferably only one such locking projection 86 is provided). By so positioning projections 86, each module is receivable in cavity 26 in a plurality of positions to permit a wide variety of modular configurations.

In use, a module 18, for example, is receivable in cavity 26 through rearwardly access opening 27. As module 18 is moved toward the front of cavity 26, along arrows A, locking projections 86 pass under rail 60 through slots 66 and into notches 42. Support members 94 contact cams 53 of termini 54 on tabs 46,48 which cooperate to guide a projection 86 into a notch 42 to thereby seat wings 92 in access portion 44. As projection 86 nears tabs 46,48, upper cammed surface 98 and underside 62 of rail 62 come into contact. As module 18 is moved further forwardly, rail 60 is urged upwardly (away) from receiving area 26 to permit wedging wall 88 to pass thereunder. Slits 68 permit a portion of wall 20 to also be urged outwardly to ease assembly. After wedging wall 88 has passed beyond rail 60, front 74 of module 18 will engage a rib 34, and/or front 87 will contact notch end wall 51, and rail 60 will return to its original position but rearwardly of wedging wall 88 to thereby lock module 18 in cell 12. As will be appreciated, rail 60 is not urged outwardly until module 18 is almost completely received in cavity 26, thus permitting non-angled insertion and removal of a module with less pressure against wall 78 than was typically believed possible with the prior art modular connector. FIG. 2 shows modules 14 and 16 tridimensionally secured in cell 12 according to the foregoing principles. The foregoing tridimensional securement applies independently for each module and, hence, does not rely on friction fit between modules to keep the connector in its assembled state.

When assembled, back 80 of the modules is in communication with rearwardly access opening 27 as seen in FIG. 2. Typically wires (not shown) would be extending therefrom to another connector, for example. Instead of one single wire (not shown) for each contact (not shown), the contacts (not shown) may be terminated by a flat flexible ribbon or cable (not shown) as is understood. To permit such a ribbon (not shown) to be received in the modules without excessive time consuming and costingly trimming, notches 100 are provided in dividers 77 and walls 82,84 of modules 14, 16,18. Similarly, notches 102 are provided in left and right walls 36,38 of cell 12 for this same purpose.

In the preferred embodiment, at least one rail 60 is provided with pivot bars 104 which may be utilized to urge rail 60 outwardly by pivoting bars 104 as indicated by arrow B in FIG. 1 to ease assembly and, especially, disassembly of connector 10.

The front 74 of each of the modules (forwardly of back 80 about slightly less than 0.6 inch) is in communication with forwardly access opening 30 to permit electrical interconnection of the contacts (not shown) to another electrical connector or the like (not shown) as is well understood. So that ribs 34 do not interfere with electrical communication, they are preferably positioned such that they coincide with one or more dividers 77 or walls 82,84 of a module and are preferably much less than 0.1 inch wide, and more preferably about 0.02 to 0.03 inch wide.

Connector 10 may be the male portion of a two-part connector and hence is receivable within another housing or header (not shown) which also has electrical contacts (not shown) matable with the contacts (now shown) carried by the modules. Thus, cell 12 may be provided with polarizing keys (not shown) and a latching mechanism (not shown) on wall 20 and/or wall 22 as desired to interconnect the two-part connector as is understood. Similarly, the principles of the present invention are applicable where cell 12 is a female modular housing or header of a two-part connector and should be understood accordingly. In that event, walls 20 and 22 will extend forwardly of ribs 34,35 to define a female receptacle or header (not shown) for a male connector (such as that shown). Thus, while the invention has been described in connection with an exemplary connector, in its broader aspects, the invention is not limited thereto.

Having described the invention, what is claimed is:

1. A modular electrical connector comprising:

a cell having an upper wall and a lower wall defining a receiving area between planar and parallel respective inner surfaces of the upper and lower walls;

a plurality of modules each adapted to carry electrical contacts between planar and parallel first and second module walls, each said module receivable in the receiving area and positionable such that when received in the receiving area, each said first module wall is adjacent a cell wall inner surface and each said second module wall is spaced from both said cell walls;

securement means on the cell walls and each said first module wall for cooperatively, tridimensionally securing each said module to the cell and to a said adjacent cell wall inner surface when the module is received in the receiving area, said securing of each said module being independent of whether any other said module is secured to the cell.

2. The modular electrical connector of claim 1, the securement means comprising notches in each said cell wall communicating with the receiving area and at least one locking projection on each said first module wall, each said locking projection comprising wall means extending from an associated said first module wall and receivable in a said notch for providing a first dimension of said tridimensional securing, each said notch having a slotted access portion spaced from the receiving area and a first tab between the slotted access portion and the receiving area, said projection including wing means spaced from and overlying said associated first module wall and sized to be received in a said slotted access portion when its associated said module is received in the receiving area, the first tab receivable between the wing means and the first module wall to prevent the wing means from passing into the receiving area when its associated said module is received in the receiving area, to provide a second dimension of said tridimensional securing.

3. The modular electrical connector of claim 2, each said access portion communicating with the receiving area via a gap alongside the first tab, the gap being narrower than the access portion, each said wall means including a support member portion between the wing means and its associated said first module wall, the support member portion sized to be receivable in a said gap.

4. The modular electrical connector of claim 3, each said notch including a second tab confronting the first tab to define the gap.

5. The modular electrical connector of claim 4, each said gap being of dove-tail cross-section, larger near the access portion and narrower at the receiving area, each said support member portion being of dove-tail cross-section to be a matably received in a said gap.

6. The modular electrical connector of claim 2, the cell having a front and a rear, and each module having a front and a rear, the securement means further comprising:

a wedging wall projecting from each said first module wall a first predetermined distance and spaced from the module front a second predetermined distance; and a slotted locking bar associated with each said cell wall exteriorly of the receiving area, each said locking bar normally spaced from the inner surface of its associated said wall inner surface a distance less than said first predetermined distance and from the cell front approximately said second predetermined distance;

each said notch having an end wall spaced forwardly of the locking bar a third predetermined distance, the wedging wall and a front of a said projection on the same said module being space apart approximately said third predetermined distance;

the wedging wall receivable through said slotted locking bar and including means urging the bar further from the inner surface of its associated said wall inner surface as the wedging wall passes therethrough until a said locking projection front contacts a said notch end wall whereupon the locking bar is resiliently returnable to its former said spacing such that the module is wedged in the receiving area thereby to provide a third dimension of said tridimensional securing.

7. The modular electrical connector of claim 6, each said notch extending from the cell rear towards the cell front.

8. The modular electrical connector of claim 7, the locking bars being positioned along the cell rear, each of the slots of the slotted locking bars in communication with a respective said notch of the associated said cell wall, a said locking projection being receivable through a said slot.

9. The modular electrical connector of claim 8, the urging means comprising a cammed surface extending from the wedging wall towards the module front and sloping towards its associated said first module wall.

10. The modular electrical connector of claim 9, the wedging wall being the rearwardmost portion of the locking projection, each said wing means spaced from its associated said first module wall less than said first predetermined distance.

11. The modular electrical connector of claim 10, the cammed surface defined along a portion of the wall means.

12. The modular electrical connector of claim 1, the receiving area further defined between a forwardly access opening and a rearwardly access opening of the cell, the cell further comprising at least one rib in the forwardly access opening extending between the cell wall inner surfaces, the modules receivable in the receiving area through the rearwardly access, opening and when so received a front of each said module contacts a said rib and communicates with the forwardly opening and a back of each said module communicates with the rearwardly opening, the securement means comprising:

a wedging wall projecting from each said first module wall a first predetermined distance and spaced from the front a second predetermined distance; and a slotted locking bar associated with each said cell wall exteriorly of the receiving area, each said locking bar normally spaced from the inner surface of its associated said wall inner surface a distance less than said first predetermined distance and from the forwardly access opening approximately said second predetermined distance, the wedging wall receivable through said slotted locking bar and including means urging the bar further from the inner surface of its associated said wall inner surface as the wedging wall passes therethrough until the module front contacts a said rib whereupon the locking bar is resiliently returnable to its former said spacing such that the module is wedged between a said vertical rib and the locking bar to provide a third dimension of said tridimensional securing.

13. The modular electrical connector of claim 12, the securement means further comprising:

notches in each said cell wall communicating with the receiving area and at least one locking projection on each said first module wall, each said locking projection comprising wall means extending from an associated said first module wall and receivable in a said notch for providing a first dimension of said tridimensional securing, each said notch having a slotted access portion spaced from the receiving area and a first tab between the slotted access portion and the receiving area, said projection including wing means spaced from and overlying said associated first module wall and sized to be received in a said slotted access portion when its associated said module is received in the receiving area, the first tab receivable between the wing means and the first module wall to prevent the wing means from passing into the receiving area when its associated said module is received in the receiving area, for providing a second dimension of said tridimensional securing.

14. The modular electrical connector of claim 13, each said notch extending from the rearwardly access opening towards the forwardly access opening.

15. The modular electrical connector of claim 14, the locking bars being positioned along the rearwardly access opening, each of the slots of the slotted locking bar in communication with a respective said notch of the associated said cell wall, a said locking projection being receivable through a said slot.

16. The modular electrical connector of claim 15, the urging means comprising a cammed surface extending from the wedging wall towards the front and sloping towards its associated said first module wall.

17. The modular electrical connector of claim 16, the wedging wall being the rearwardmost portion of the locking projection, each said wing means spaced from its associated said first module wall less than said first predetermined distance.

18. The modular electrical connector of claim 17, the cammed surface defined along a portion of said wall means.

19. A cell for a modular electrical connector comprising:

a first wall;

a lower second wall spaced from the first wall to define a receiving area adapted to receive modules between planar and parallel inner surfaces of the first and second walls and between forwardly and rearwardly edges of the walls which define a forwardly access opening and a rearwardly access opening;

securement means on said first wall, cooperable with a securement mechanism on a module, for tridimensionally securing a module to the cell and to the first cell wall inner surface when a module is received in the receiving area, said securing of a module being independent of whether any other module is secured to the cell and independent of the second cell wall.

20. The cell of claim 19, the securement means comprising:

a notch on said first wall communicating with the receiving area, said notch extending from the rearwardly edge thereof towards the forwardly edge thereof and adapted to receive a wall portion of a locking projection of a module to provide a first said dimension of securing a module to the cell, said notch having a slotted access portion spaced from the receiving area and adapted to receive therein a mating wing of a module locking projection and a first tab between the slotted access portion and the receiving area to prevent a module wing received in the access portion from passing into the receiving area to provide a second said dimension of securing a module to the cell.

21. The cell of claim 19, the securement means comprising:

a notch on said first wall communicating with the receiving area, said notch extending from the rearwardly edge thereof towards the forwardly edge thereof; and a slotted locking bar associated with said first wall along the rearwardly edge thereof exteriorly of the receiving area, said locking bar normally spaced from the inner surface of said first wall a first predetermined distance;

said notch having an end wall spaced forwardly of the locking bar a second predetermined distance, said locking bar urgeable from said normal spacing as a wedging wall of a module passes through a slot in the locking bar, an end of a module locking projection spaced forwardly of a wedging wall said second predetermined distance contacting said notch end wall and said locking bar returnable to said normal spacing to thereby contact a module wedging wall to wedge a module in the receiving area thereby to provide a said dimension of securing a module to the cell.

22. The cell of claim 19, the securement means comprising:

at least one rib in the forwardly access opening extending between the upper and lower walls; and a slotted locking bar associated with said first wall along the rearwardly edge thereof exteriorly of the receiving area, said locking bar normally spaced from the inner surface of said first wall a predetermined distance and urgeable therefrom as a wedging wall of a module passes through a slot in the locking bar to wedge a module betweeen a said rib and the locking bar to provide a said dimension of securing a module to the cell.

23. The cell of claim 20, the securement means further comprising:

a slotted locking bar associated with said first wall along the rearwardly edge thereof exteriorly of the receiving area, said locking bar normally spaced from the inner surface of said first wall a first predetermined distance;

said notch having an end wall spaced forwardly of the locking bar a second predetermined distance, said locking bar urgeable from said normal spacing as a wedging wall of a module passes through a slot in the locking bar, an end of a module locking projection spaced forwardly of a wedging wall said second predetermined distance contacting said notch end wall and said locking bar returnable to said normal spacing to thereby contact a module wedging wall to wedge a module in the receiving area thereby to provide a third said dimension of securing a module to the cell.

24. The cell of claim 20, the securement means further comprising:

at least one rib in the forwardly access opening extending between the first and second walls; and a slotted locking bar associated with said first wall along the rearwardly edge thereof exteriorly of the receiving area, said locking bar normally spaced from the inner surface of said first wall a predetermined distance and urgeable therefrom as a wedging wall of a module passes through a slot in the locking bat to wedge a module between a said rib and the locking bar to provide a third said dimension of securing a module to the cell.

25. A module for a modular electrical connector and receivable in a receiving area of a cell defined between inner surfaces of first and second parallel cell walls, the module adapted to carry electrical contacts between planar and parallel first and second module walls, securement means on the first module wall, cooperable with a securement mechanism on a first cell wall, for tridimensionally securing the module to a cell such that the first module wall is adjacent a first cell wall inner surface and the second module wall is spaced from both cell wall inner surfaces when the module is received in a cell receiving area, said securing of the module being independent of whether any other module is secured to a same cell and independent of a second cell wall inner surface.

26. The module of claim 25, the securement means comprising:

at least one locking projection on the first wall, the projection having wall means extending from the first wall and receivable in a notch in a first cell wall to provide a first said dimension of securing the module to a cell, the projection including wing means spaced from and overlying the first wall and receivable in a slotted access portion over a tab of a notch in a first cell wall when the module is received in a cell for providing a second said dimension of securing the module to a cell.

27. The module of claim 26, the wedging wall being a portion of the locking projection and spaced further from the module front than any other portion of the locking projection.

28. The module of claim 27, the wing means spaced from the first wall a distance less then said predetermined distance.

29. The module of claim 28 including a cammed surface extending from said wedging wall forwardly towards said wing means.

30. The module of claim 25, the securement means comprising:

at least one wedging wall projecting from the first wall a predetermined distance and spaced from a front of the module to provide a wedging surface for a locking bar of a cell to wedge the module in a cell between a forwardly rib of a cell and a locking bar to provide a said dimension of securing the module to a cell.

31. The module of claim 26, the securement means further comprising:

at least one wedging wall projecting from the first wall a predetermined distance and spaced from a front of the module to provide a wedging surface for a locking bar of a cell to wedge the module in a cell between a forwardly rib of a cell and a locking bar to provide a third said dimension of securing the module to a cell.

32. The module of claim 31, the wedging wall being a portion of the locking projection and spaced further from the front than any other portion of the locking projection.

33. The module of claim 32, the wing means spaced from the first wall a distance less than said predetermined distance.

34. The module of claim 33 including a cammed surface extending from said wedging wall forwardly towards said wing means.

35. The module of claim 25, the securement means comprising:

at least one wedging wall projecting from the first wall a predetermined distance and spaced from a front of a backing projection to provide a wedging surface for a locking bar of a cell to wedge the module in a cell such that the front of the projection contacts an end wall of a cell notch and the wedging wall is contacted by a locking bar to provide a said dimension of securing the module to a cell.

36. The module of claim 26, the securement means further comprising:

at least one wedging wall projecting from the first wall a predetermined distance and spaced from a front of the projection to provide a wedging surface for a locking bar of a cell to wedge the module in a cell such that the front of the projection contacts an end wall of a cell notch and the wedging wall is contacted by a locking bar to provide a said dimension of securing the module to a cell.

37. The module of claim 36, the wedging wall being a portion of the locking projection and spaced further from the module front than any other portion of the locking projection.

38. The module of claim 37, the wing means spaced from the first wall a distance less than said predetermined distance.

39. The module of claim 38 including a cammed surface extending from said wedging forwardly towards said wing means.

40. A cell for a modular electrical connector comprising:

a plurality of cell walls defining a receiving area adapted to receive modules therein and between forwardly and rearwardly edges of the cell walls which define a forwardly access opening and a rearwardly access opening;

securement means on a first said cell wall, cooperable with a securement mechanism on a wall of a module, for tridimensionally securing a module to the first cell wall when a module is received in the receiving area, said securing of a module being independent of whether any other module is secured to the cell and independent of any other cell wall.

41. A module for a modular electrical connector and receivable in a receiving area of a cell defined between a plurality of cell walls, the module adapted to carry electrical contacts between first and second module walls, securement means on the first module wall, cooperable with a securement mechanism on a first cell wall, for tridimensionally securing the module to a cell such that the first module wall is adjacent a first cell wall and the second module wall is spaced from any other cell wall when the module is received in a cell receiving area, said securing of the module being independent of whether any other module is secured to a same cell and independent of any other cell wall.

42. A modular electrical connector comprising:

a cell having a plurality of walls defining a receiving area therebetween;

a plurality of modules each adapted to carry electrical contacts between first and second module walls, each said module receivable in the receiving area and positionable such that when received in the receiving area, each said first module wall is adjacent a respective said cell wall and each said second module wall is spaced from any other said cell wall;

securement means on the cell walls and each said first module wall for cooperatively, tridimensionally securing each said module to the cell and to a said adjacent cell wall when the module is received in the receiving area, said securing of each said module being independent of whether any other said module is secured to the cell.

* * * * *

UNITED STATES PATENT AND TRADEMARK OFFICE

CERTIFICATE OF CORRECTION

PATENT NO. : 4,682,839

DATED : July 28, 1987

INVENTOR(S) : J. Robert Bryce

It is certified that error appears in the above-identified patent and that said Letters Patent is hereby corrected as shown below:

Col. 10, line 50, "a lower second wall" should be --a second wall--

Col. 12, line 11, "bat" should be --bar--

Col. 13, line 18, "backing" should be --locking--

Col. 13, line 44, "wedging forwardly" should be --wedging wall forwardly--

Signed and Sealed this

Twenty-ninth Day of December, 1987

*Attest:*

DONALD J. QUIGG

*Attesting Officer*

*Commissioner of Patents and Trademarks*